US009204235B2

(12) United States Patent
Sheu

(10) Patent No.: US 9,204,235 B2
(45) Date of Patent: Dec. 1, 2015

(54) DEVICE FOR MEASURING SOUND WAVES EMITTED BY SOUND-EMITTING DEVICE

(71) Applicant: HON HAI PRECISION INDUSTRY CO., LTD., New Taipei (TW)

(72) Inventor: Yi-Zhong Sheu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 194 days.

(21) Appl. No.: 13/960,810

(22) Filed: Aug. 7, 2013

(65) Prior Publication Data

US 2014/0177852 A1 Jun. 26, 2014

(30) Foreign Application Priority Data

Dec. 21, 2012 (TW) ..... 101148885 A

(51) Int. Cl.
*H04R 29/00* (2006.01)

(52) U.S. Cl.
CPC ..... *H04R 29/001* (2013.01)

(58) Field of Classification Search
CPC ..... H04R 29/00; H04R 29/001
USPC ..... 381/58
See application file for complete search history.

(56) References Cited

U.S. PATENT DOCUMENTS

2010/0247857 A1* 9/2010 Sanami ..... H04M 1/18 428/138

* cited by examiner

*Primary Examiner* — Sonia Gay
(74) *Attorney, Agent, or Firm* — Novak Druce Connolly Bove + Quigg LLP

(57) ABSTRACT

A sound-measuring device for measuring average amplitude of sound waves of a sound-emitting device is provided. The sound-measuring device includes an integration circuit, a laser diode, a driver configured to drive the laser diode to emit a laser beam, a storage unit, a light sensing unit, a first optical fiber and a second optical fiber aligned with the first optical fiber. The first optical fiber is placed on the sound insulating film. The sound waves of the sound-emitting device causes the insulating film to vibrate thereby the vibration of the insulating film causing misalignment between the first optical fiber and the second optical fiber. The integration circuit calculates an insertion loss value between the portion of the laser beam and the laser beam from the laser diode, and determines average amplitudes of the sound waves according to the table and the calculated insertion loss value.

3 Claims, 2 Drawing Sheets

DEVICE FOR MEASURING SOUND WAVES EMITTED BY SOUND-EMITTING DEVICE

BACKGROUND

1. Technical Field

The present disclosure relates to measuring devices, and particularly to a device for measuring an average amplitude of sound waves emitted by a sound-emitting device.

2. Description of Related Art

When measuring amplitudes of sound waves of a sound-emitting device, device which includes a sound insulating film, a metal sheet, and a capacitance sensor is required. The sound-emitting device emits the sound waves, which change a distance between the sound insulating film and the metal sheet, thereby changing a current capacitance value between the sound insulating film and the metal sheet. The amplitude of the sound waves is calculated according to an offset value between the current capacitance value and an original capacitance value. However, the cost for setting up the mechanism is high.

Therefore, what is needed is a device to overcome the above described limitations.

DETAILED DESCRIPTION

Figure 1:
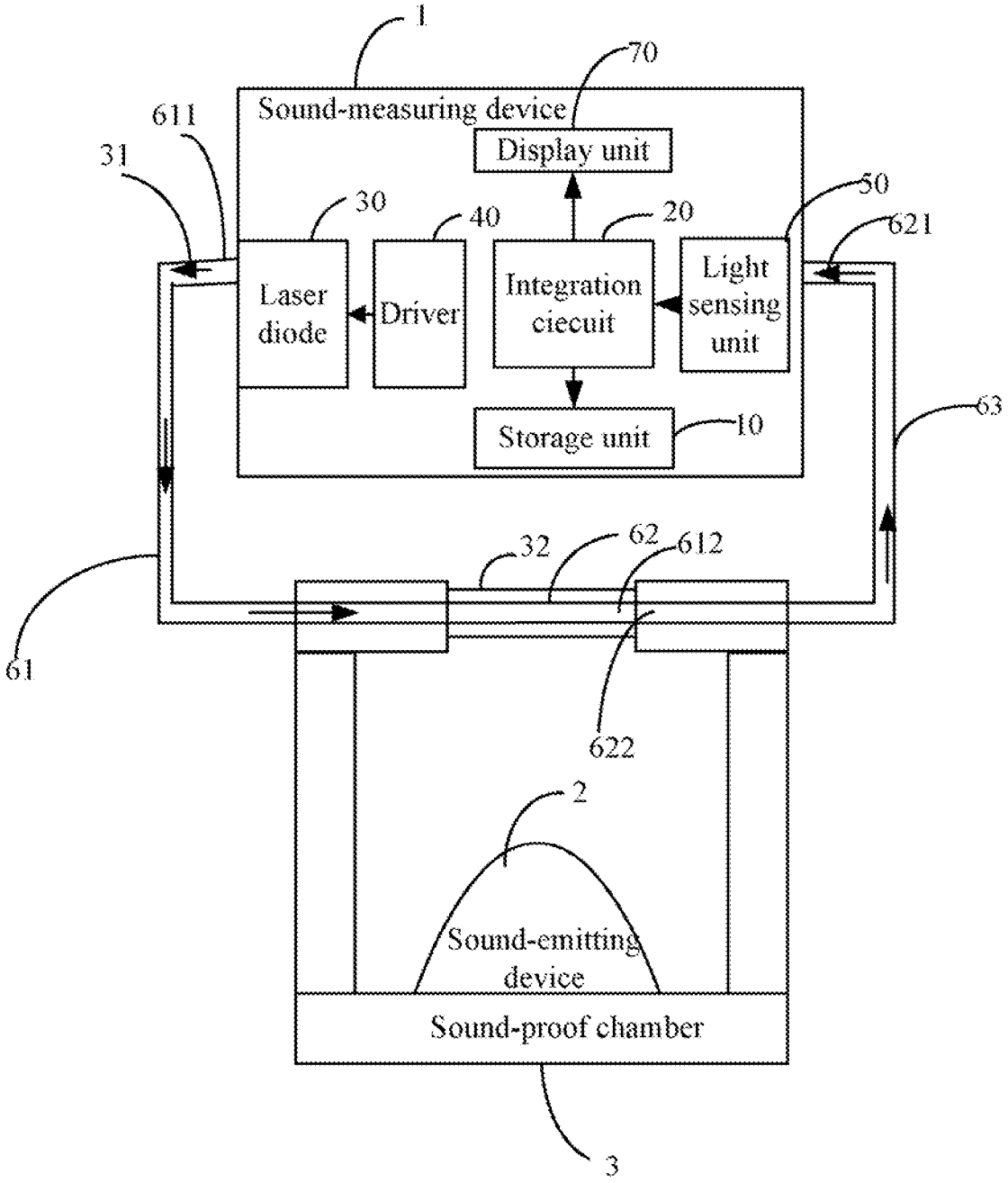
FIG. 1 is a schematic diagram of a sound-measuring device for measuring amplitude of the sound waves of a sound emitting device in accordance with an exemplary embodiment.

FIG. 1 shows a sound-measuring device 1 for measuring an average amplitude of sound waves of a sound-emitting device 2. The sound-emitting device 2 includes a sound-proof chamber 3 for receiving the sound-emitting device 2. The sound-proof chamber 3 includes a sound insulating film 32 facing toward sound-emitting device 2. In one embodiment, the sound-emitting device 2 is a microphone.

The sound-measuring device 1 includes a storage unit 10, an integration circuit 20, a driver 40, a laser diode 30, a light sensing unit 50, and a first optical fiber 61, and a second optical fiber 62.

The storage unit 10 stores a table which records a mapping relationship between insertion loss values caused by the sound waves and average amplitudes of the sound waves of the sound-emitting device 2. The first optical fiber 61 has a first end 611 optically coupled to the laser diode 30 and an opposite second end 612. The second optical fiber 62 has a first end 621 optically coupled to the light sensing unit 50 and an opposite second end 622. The second end 612 of the first optical fiber 61 is being placed on the sound insulating film 32 and optical alignment with the second end 622 of the second optical fiber 62.

The driver 40 drives the laser diode 30 to emit a laser beam 31. The first optical fiber 61 and the second optical fiber 62 transmit the laser beam 31 to the light sensing unit 50.

Figure 2:
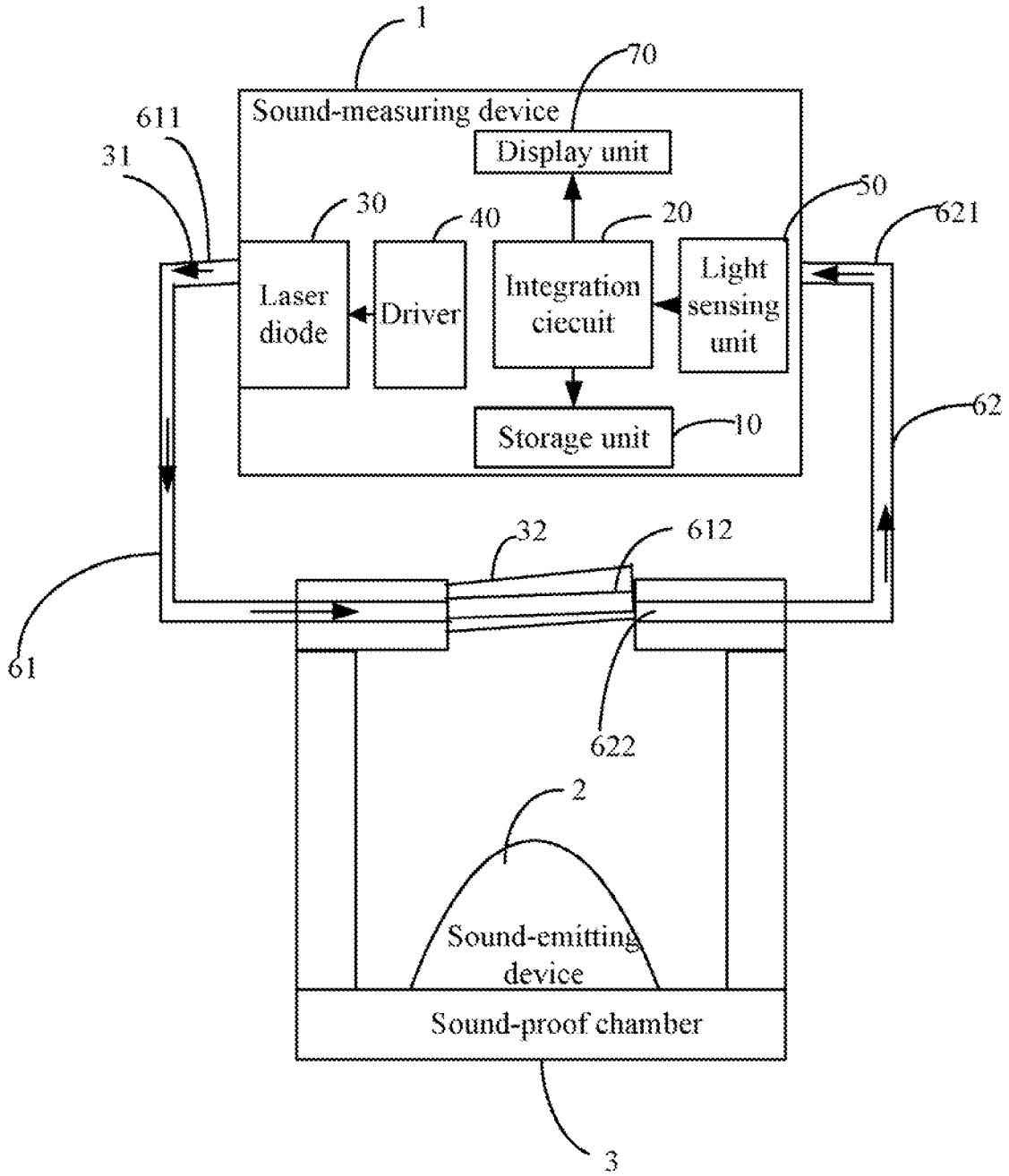
FIG. 2 shows a change of position of a first optical fiber of the sound-measuring device of FIG. 1.

Referring to FIG. 2, the sound-emitting device 2 emits the sound waves which causes misalignment between the second end 612 of the first optical fiber 61 and the second end 622 of the second optical fiber 62, thereby causing a portion of the laser beam 31 being transmitted to the sensing unit 50, and a remaining portion of the laser beam 31 being lost. The sensing unit 50 senses the portion of the laser beam 31 from the second optical fiber 62. The integration circuit 20 calculates an insertion loss value between the sensed portion of the laser beam 31 and the laser beam 31 from the laser diode 30, and determines an average amplitude value of the sound waves according to the table and the calculated insertion loss value.

The sound-measuring device 1 further includes a display unit 70 to display the amplitude value of the sound waves of the sound-emitting device 2.

Although various embodiments have been specifically described, the disclosure is not to be construed as being limited thereto. Various changes or modifications may be made to the embodiments without departing from the scope and spirit of the disclosure.

What is claimed is:

1. A sound-measuring device for measuring an average amplitude of sound waves of a sound-emitting device, comprising:

a sound-proof chamber configured to receive the sound-emitting device therein, the sound-proof chamber comprising a sound insulating film facing toward the sound-emitting device;

an integration circuit;

a laser diode;

a driver configured to drive the laser diode to emit a laser beam;

a storage unit configured to store a table;

a light sensing unit;

a first optical fiber having a first end optically coupled to the laser diode and an opposite second end; and a second optical fiber having a first end optically coupled to the light sensing unit and an opposite second end, the second end of the first optical fiber being placed on the sound insulating film and configured for optical alignment with the second end of the second optical fiber, the sound waves of the sound-emitting device causing the sound insulating film to vibrate thereby the vibration of the sound insulating film causing misalignment between the second end of the first optical fiber and the second end of the second optical fiber, thereby causing a portion of the laser beam being transmitted to the light sensing unit and sensed by the light sensing unit, and a remaining portion of the laser beam being lost is insertion loss value, the table recording a mapping relationship between insertion loss values caused by the sound waves and average amplitudes of the sound waves;

wherein the integration circuit is configured to calculate an insertion loss value between the portion of the laser beam sensed by the light sensing unit and the laser beam from the laser diode, and determine an average amplitude of the sound waves according to the table and the calculated insertion loss value.

2. The sound-measuring device for detection sound waves of a sound-emitting device as described in claim 1, wherein the sound-emitting device is a microphone.

3. The sound-measuring device for detection sound waves of a sound-emitting device as described in claim 1, further comprising:

a display unit configured to display the average amplitude value of the sound waves of the sound-emitting device.

* * * * *